US005540520A

United States Patent [19]

Aune

[11] Patent Number: 5,540,520

[45] Date of Patent: Jul. 30, 1996

[54] PORTABLE FOLDING BOAT SKIDWAY

[76] Inventor: Harold J. Aune, P.O. Box 1141 Stn. E., Victoria, British Columbia, Canada, V8W 2T6

[21] Appl. No.: 236,201

[22] Filed: Apr. 28, 1994

Related U.S. Application Data

[63] Continuation-in-part of Ser. No. 454,310, Dec. 22, 1989, abandoned, and Ser. No. 743,316, Oct. 11, 1991, Pat. No. 5,316,409.

[51] Int. Cl.[6] ..... B63C 3/00

[52] U.S. Cl. ..... 405/1; 193/35 F

[58] Field of Search ..... 405/1, 2, 3, 7; 182/196, 197, 198; 193/35 F, 35 SS; 114/44–48

[56] References Cited

U.S. PATENT DOCUMENTS

| | | | |
|---|---|---|---|
| 321,385 | 6/1885 | Pyne | 182/196 X |
| 376,216 | 1/1888 | Stillman | 182/196 X |
| 1,487,634 | 3/1924 | Waters | 193/35 F |
| 1,935,734 | 11/1933 | Twomley | 193/35 F |
| 2,238,655 | 4/1941 | McAdams | 193/35 F |
| 2,307,389 | 1/1943 | Carter | 193/35 F |
| 2,550,201 | 4/1951 | Parisi | 193/35 F |
| 3,741,340 | 6/1973 | Andrews | 182/196 |
| 3,773,195 | 11/1973 | Honea | 193/35 SS X |
| 3,944,037 | 3/1976 | Stease | 193/35 FX |

FOREIGN PATENT DOCUMENTS

| | | | |
|---|---|---|---|
| 136446 | 9/1933 | Austria | 193/35 F |
| 72032 | 1/1951 | Denmark | 193/35 F |

*Primary Examiner*—Dennis L. Taylor
*Attorney, Agent, or Firm*—David J. French

[57] ABSTRACT

A portable skidway utilizes tubular skidding cylinders joined by connecting rods that encircle the ends of the cylinders and are contained within flanges. The rods align tangentially with the outer surface of the cylinders to locate such rods directly on the ground when the skidway is in use.

2 Claims, 1 Drawing Sheet

4
1
2
3
11

8
1

5a
3
5b
13
1
2
8
6

3
2

5b
2

10
2
11
9

PORTABLE FOLDING BOAT SKIDWAY

This application is a continuation-in-part of U.S. patent application Ser. No. 454,310 filed Dec. 22, 1989, now abandoned and a Continuation-in-Part of U.S. patent application Ser. No. 07/743,316 filed Nov. 11, 1991, now U.S. Pat. No. 5,316,409.

FIELD OF THE INVENTION

This invention relates to an articulated skidway for a boat wherein the skidway is both collapsible and readily portable. More specifically, this invention relates to an apparatus that is readily transportable and easily deployable on a beach or shoreline to provide a skidway by which a boat may be launched or drawn-up out of the water.

BACKGROUND TO THE INVENTION

The need to provide lightweight skidways for small craft to permit them to be launched or drawn-up on a shoreline has previously been recognized. An example of a prior art patent addressing this objective is the Italian patent No. 480,348 to Giacomo Ghiglione.

The patent to Ghiglione shows a series of transverse slider bars, depicted as being made of wood, held together in an articulated ladder-like array by a series of rods that interconnect joints in the form of pins centrally positioned at the end of each bar or "rung". The specific structure of Ghiglione relies upon an upper wooden rung upon which the keel of a boat may be slid. This rung is fastened from below to a metal bar that is up-turned at its outside ends to provide a mount for the pin to which inter-rung connecting rods are attached. Thus the connections between the rods and rungs in Ghiglione are positioned above the surface carrying the skidway, as are the interconnecting links. Further Ghiglione does not use a tubular skidding cylinder which may be rotated to reposition its upper surface and thereby distribute wear.

The present invention is an improvement on PCT application No. PCT/CA 90/00456 published 11 Jul., 1991 under the title "PORTABLE BOAT SKIDWAY". In that application a series of skidding tubes are held in position by a ladder-like array of rods. The tubes, preferably of high density polymeric material are positioned on the "rung" links of the ladder-like array.

As in the Ghiglione reference the links interconnecting each "rung" are held off from being in direct contact with the ground where the interconnecting rods are joined to each other. This elevation above ground level exposes the interconnecting rods to being tripped-over or bent by passing individuals or vehicles. As well, both designs display lateral slackness which makes them more difficult to collapse by folding.

Neither of these references provide a skidway which has the feature of being closely positioned adjacent to the ground when deployed, and compactly collapsible with convenience for storage.

With this background in mind, the invention in its general form will first be described, and then its implementation in terms of specific embodiments will be detailed with reference to the drawings following hereafter. These embodiments are intended to demonstrate the principle of the invention, and the manner of its implementation. The invention will then be further described, and defined, in each of the individual claims which conclude this Specification.

SUMMARY OF THE INVENTION

According to the invention an articulated skidway is provided by a series of connecting rods, each joined at its respective ends to the ends of corresponding tubular skidding cylinders which serve as rungs in a ladder-like formation. The ends of the rods are coupled to the ends of the cylinders by encircling such tubes. At each end of each cylinder a pair of constraining flanges are provided to contain and align the encircling ends of the two connecting rods attached to each ends of such cylinders, thereby causing the skidway to be folded with the ends of the skidding tubes in relative alignment.

As a preferred feature, the connecting rods are themselves tangentially aligned with the outer surfaces of the tubular cylinders at the point where the encircling ends commence to curve around such cylinders.

The tubular skidding cylinder is preferably of a large diameter vis, 4 to 6 cm relative to the connecting rods (e.g. ½ cm). By selection of a large diameter for the tubular cylinders and the close containment of the circular ends of the connecting rods by flanges, the skidway will fold readily upon itself with minimal sideways skewing. In its folded state, this product is small enough to be easily stored in a small space, e.g. a boat locker, car trunk etc. Further, it is light enough to be easily carried and deployed by any average person.

The foregoing summarizes the principal features of the invention. The invention may be further understood by the description of the preferred embodiments, in conjunction with the drawings, which now follow.

DESCRIPTION OF PREFERRED EMBODIMENTS

Figures 1, 2, 3, 4, 5, 6:
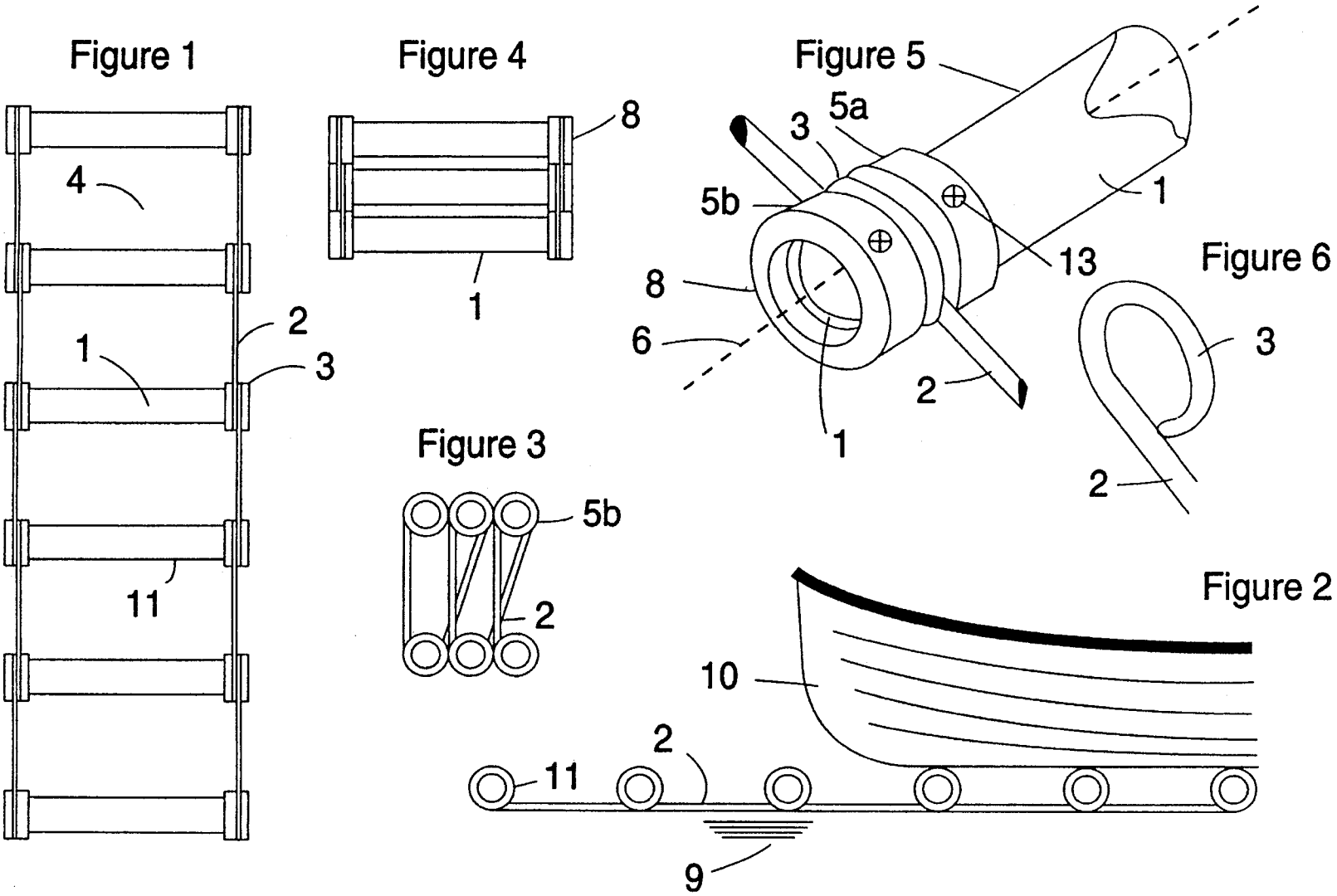
FIG. 1 is a plan view of the skidway, as deployed.
FIG. 2 is a side view of the skidway when deployed with a boat positioned thereon.
FIG. 3 is a side view of the skidway when fully folded.
FIG. 4 is a top view of the skidway when fully folded.
FIG. 5 shows a perspective view of the detail of the encirclement of a skidding tube by the encircling ends of two connecting rods and their containment by flanges.
FIG. 6 shows a rod with an encircling end that permits the rods to align tangentially with the skidding cylinder.

In FIG. 1 a series of skidding tubes or cylinders 1 are held in position by connecting rods 2. The respective encircling ends 3 of each rod 2 are bent in almost a full circle to embrace the outer surface 11 of two respective tubes 1, near the outer ends 8 of such tubes 1. The result is to form a ladder-like formation which serves as a skidway 4.

The encircling ends 3 of consecutive rods 2 are preferable placed proximate to each other, in pairs, as they engage with the tubes 1. These paired ends 3 are contained by a pair of flanges *5a*, *5b* that serve as retainers to constrain the encircling ends 3 in place. The flanges *5a*, *5b* are preferably positioned close together, so as to contain the encircling ends 3 with minimal lateral play. This reduces the risk that a twisting force applied to a rod 2 will tend to spread-open the bent, encircling end 3. Such flanges *5a*, *5b* may be fastened to the cylinders as by self-taping screws 13 to allow for adjustment and ready disassembly.

Because of the relative diameter of the rods 2 and tube 1, vis ½ cm and 4 to 10 cm, and the tight fit of the encircling ends 3 on the tubes 1, together with their confignment, the connecting rods 2, while free to rotate, do so substantially about an axis that is co-incident with the axis 6 of the associated tube. By use of tubes 1 and rods 2 each of constant length, the skidway 4 will fold readily into the configuration of FIGS. 3 and 4. In particular, the tubes 1 when folded not only remain parallel, but are also packed together with their ends 8 substantially aligned. This creates a compact format for storage.

In use, the skidway 4 may be laid-out on a surface 9, such as a beach, as shown in FIG. 2. A boat 10 or other vehicle may then be skidded over the tubes 1. By use of high density polymeric material for such tubes 1, such as polypropylene or polyethylene, minimal friction will arise in this skidding process.

In FIG. 2 a further advantage of the preferred coupling arrangement of the invention is apparent. By bending the encircling ends 3 of each rod 2 so that the rod 2 is aligned tangentially at the outer surface 11 of the tube 1 around which it is bent, each rod 2 will be positioned directly on the ground surface 9 along its length. This condition differs from other configurations wherein the rods 2 connect to the tubes 1 at positions elevated above the ground surface 9. The new arrangement with the rods 2 positioned on the ground reduces the prospect that passers-by will trip over such rods 2. Also, if stepped on, or run-over by a vehicle, the rods 2 are less likely to be bent.

Either or both ends of the skidway may be anchored. The skidding cylinder, being composed of a length of pipe made of a material which is intrinsically slippery, will not act as a roller but will be restrained by the ground surface from rotating in use. However, such tubes 1 can be manually rotated to reposition the exposed portion and distribute wear over the outer surface 11.

The foregoing disclosure therefore shows how and folding articulated slipway of low cost may be formed from lightweight components, that may be easily stored and transported, and which will provide satisfactory service for lightweight boats and the like when assembled.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed as follows:

1. An articulated skidway comprising a plurality of connecting rods and low-friction skidding tubes each having a longitudinal tube axis and an outside skidding surface, the ends of said rods being joined to the ends of corresponding skidding tubes in an articulated fashion for rotation about said tube axis to produce a ladder-like formation wherein the tubes serve as rungs, said ends of the rods being coupled to the ends of the tubes by encircling such tubes and being contained in place by a pair of the constraining flanges mounted on said tubes to contain and align the encircling ends of the connecting rods with such tubes, the inter-rung portions of the connecting rods being tangentially aligned with the outer surfaces of the skidding tubes at the point where the encircling ends commence to curve around such tubes to allow such rods to lie below or at the bottom level of the skidding tubes when the skidway is deployed upon a surface.

2. A skidway as in claim 1 wherein the tubular skidding tubes are of a diameter of at least 4 cm relative to the connecting rods and are made of a low friction, high density, sun-resistant polymeric plastic.

* * * * *